US008808499B2

(12) United States Patent
Bylander et al.

(10) Patent No.: US 8,808,499 B2
(45) Date of Patent: Aug. 19, 2014

(54) APPARATUS FOR WASHING AND DEWATERING PULP, A SYSTEM FOR CONTROLLING SUCH AN APPARATUS, AND A METHOD FOR PROCESSING PULP IN SUCH AN APPARATUS

(75) Inventors: Johan Bylander, Sundsvall (SE); Fredrik Pontén, Sundsvall (SE); Rickard Andersson, Matfors (SE); Magnus Danielsson, Matfors (SE)

(73) Assignee: Valmet Technologies, Inc. (FI)

( * ) Notice: Subject to any disclaimer, the term of this patent is extended or adjusted under 35 U.S.C. 154(b) by 588 days.

(21) Appl. No.: 12/747,648

(22) PCT Filed: Dec. 11, 2008

(86) PCT No.: PCT/SE2008/051443

§ 371 (c)(1), (2), (4) Date: Jun. 11, 2010

(87) PCT Pub. No.: WO2009/075645

PCT Pub. Date: Jun. 18, 2009

(65) Prior Publication Data

US 2010/0276094 A1 Nov. 4, 2010

(30) Foreign Application Priority Data

Dec. 13, 2007 (SE) ..... 0750011

(51) Int. Cl.

| | |
|---|---|
| ***D21C 1/02*** | (2006.01) |
| ***D21D 1/40*** | (2006.01) |
| ***D21C 9/06*** | (2006.01) |
| ***D21C 9/18*** | (2006.01) |
| ***D21F 1/66*** | (2006.01) |

(52) U.S. Cl.

CPC .. *D21D 1/40* (2013.01); *D21C 9/06* (2013.01); *D21C 9/18* (2013.01); *D21F 1/66* (2013.01)

USPC ..... 162/60; 162/56; 162/61

(58) Field of Classification Search

USPC ..... 162/56

See application file for complete search history.

(56) References Cited

U.S. PATENT DOCUMENTS 3,730,079 A * 5/1973 Stirk et al. ..... 100/121
3,820,452 A * 6/1974 Eriksson et al. ..... 100/37

(Continued)

FOREIGN PATENT DOCUMENTS

EP 1035250 A2 9/2000
GB 1041194 A 9/1966

(Continued)

OTHER PUBLICATIONS

Philip Morris, Stock Prep, Legacy Tobacco Documents Library, 2002.*

(Continued)

*Primary Examiner* — Anthony Calandra

(74) *Attorney, Agent, or Firm* — Lerner, David, Littenberg, Krumholz & Mentlik, LLP

(57) ABSTRACT

Methods for processing pulp in an apparatus for washing and dewatering pulp and a system for controlling this apparatus are provided. The apparatus includes a pair of rotatable press rolls installed in vats and including a press nip therebetween, an inlet for feeding the pulp to the press nip, with one of the press rolls being movable in relation to the other and in which the processing of the pulp is determined by the number of variable operating parameters. The method includes utilizing the distance between the press rolls as a variable operating parameter, setting a desired value for a specific control parameter, measuring the specific control parameter, and adjusting at least two of the variable operating parameters during operation to maintain the difference between the desired value and the measured value of the specific control parameter below a predetermined difference. Systems for controlling this apparatus are also disclosed.

11 Claims, 4 Drawing Sheets

(56) References Cited

U.S. PATENT DOCUMENTS

| | | | | |
|---|---|---|---|---|
| 3,878,698 | A * | 4/1975 | Friksson et al. | 68/22 R |
| 4,044,580 | A | 8/1977 | Worden et al. | |
| 6,228,222 | B1 | 5/2001 | Meschenmoser et al. | |
| 6,311,849 | B1 | 11/2001 | Sbaschnigg et al. | |

FOREIGN PATENT DOCUMENTS

| | | | |
|---|---|---|---|
| GB | 1388079 | A | 3/1975 |
| SE | 518086 | C2 | 8/2002 |
| WO | 2005114124 | A1 | 12/2005 |

OTHER PUBLICATIONS

Definition of automatic control, downloaded from tpub.com, downloaded online Jan. 14, 2013.*
Ingersoll and Rand, I-R Industrial Process Machinery, Legacy Tobacco Documents Library, 2002.*
Bosch Group, Electric, Hydraulics, Pneumatics: Evaluating Their Advantages for Automative Manufacturing Processes, 2006.*
Phillip Morris, Line III Training Manual for Stock Prep Area (hvm86e00), 1998, Legacy Tobacco Documents Library.*
Phillip Morris, Ingersoll-Rand Vari-Nip Press, 1998, Legacy Tobacco Documents Library.*
"Sulphite Washing with the Vari-Nip Twin Roll Press", Chemical Recovery Workshop, Sponsored by the Sulphite Committee, Mar. 27-29, 1979, pp. 71-84, Montreal, Quebec.
Sandberg, Washing of Pulp, Markaryd Publishing (1994), 6 pages.
Schmidtbauer et al., Analogue and Digital Control Engineering, Sections 1.5, 1.6 (1988).
Perkins et al., Sulphite Wasing with the Vari0Nip Twin Roll Press, Mar. 27, 1979.
Ingersoll-Rand, "Vari-Nip" Twin Roll Press Model—TRC, Jul. 14, 2010 (at Swedish Patent Office).
Papermaking Science and Technology/edited by Gull ichsen, J et al. Book 6A, "Chemical Pulping", published by Fapet Oy, printed 2000, ISBN 952-5216-06-3 (book 6), p. A592-A594.
International Search Report for Application No. PCT/SE2008/051443 dated Mar. 13, 2009.

* cited by examiner

APPARATUS FOR WASHING AND DEWATERING PULP, A SYSTEM FOR CONTROLLING SUCH AN APPARATUS, AND A METHOD FOR PROCESSING PULP IN SUCH AN APPARATUS

CROSS-REFERENCE TO RELATED APPLICATIONS

The present application is a national phase entry under 35 U.S.C. §371 of International Application No. PCT/SE2008/051443 filed on Dec. 11, 2008, published in English, which claims priority from Swedish Patent Application No. 075011-9 filed Dec. 13, 2007, all of which are incorporated herein by reference.

FIELD OF THE INVENTION

The present invention relates to a method for processing pulp, especially cellulose-containing pulp, in an apparatus for washing and dewatering such pulp comprising two rotatable press rolls having a permeable outer surface, and a vat in which the press rolls are installed, the press rolls defining a press nip between them, in which press nip the pulp is pressed. The apparatus is arranged to feed the pulp in the direction of rotation of the press rolls through the press nip, at least one of the press rolls being movable in relation to the other press roll to vary the press nip, and the processing of the pulp in the apparatus is determined by a set of variable operating parameters which are variable during operation. More particularly, the present invention also relates to a system for controlling an apparatus of the above-mentioned type, and to apparatus of the above-mentioned type comprising a system for controlling such apparatus.

BACKGROUND OF THE INVENTION

When producing cellulose-based products, a roll press is frequently used for washing and dewatering the cellulose-based pulp. The pulp is passed between two cooperating press rolls installed in the roll press, the press rolls having a perforated outer surface, a so called mantle surface, whereby the outer surface is permeable to liquid pressed out of the pulp, and the pulp is pressed in the roll nip, or the press nip, between the press rolls, whereby liquid is pressed out of the pulp. The roll press also includes one or more washing zones prior to the press nip. One example of such a roll press is disclosed in European Patent No. 1,035,250, in which the central axes of the press rolls lie in substantially the same horizontal plane, and the pulp is fed in the direction of rotation of the press rolls through the press nip, and the pulp passes through the press nip between the press rolls from below upwards.

U.S. Pat. No. 3,730,079 discloses a press comprising two press rolls rotatable about parallel axes, wherein one of the press rolls is laterally movable relative to the other to vary the cross-section of the press nip therebetween. A pressing force is applied to the laterally movable press roll by a plurality of separate link systems actuated by individual fluid pressure operated actuators. Pneumatically expansible tubes or springs are provided to urge the movable press roll away from the other press roll. The object of this press is to maintain the axes of the press rolls parallel while permitting relative lateral movement of the press rolls.

However, there is a need for improved processing of pulp in an apparatus for washing and dewatering pulp comprising two rotatable press rolls, which can more accurately provide pulp with the desired quality, and which increases the capacity of the apparatus.

One object of the present invention is thus to provide for improved processing of pulp in an apparatus for washing and dewatering pulp comprising two rotatable press rolls.

SUMMARY OF THE INVENTION

In accordance with the present invention, this and other objects have now been realized by the invention of a method for processing pulp in an apparatus for washing and dewatering the pulp comprising first and second rotatable press rolls, each of the first and second rotatable press rolls including a permeable outer surface, and a vat in which the first and second rotatable press rolls are installed, the first and second rotatable press rolls juxtaposed with each other to define a press nip for passing the pulp therebetween, feed means for feeding the pulp in the direction of rotation of the first and second rotatable press rolls through the press nip, at least one of the first and second rotatable press rolls being movable in relation to the other of the first and second rotatable press rolls to vary the press nip, whereby the processing of the pulp in the apparatus is determined by a plurality of variable operating parameters which are variable during operation, the method comprising including the distance between the first and second rotatable press rolls as one of the plurality of variable operating parameters, setting at least one desired value for a specific control parameter of a plurality of control parameters, measuring the specific control parameter and adjusting at least two of the plurality of variable operating parameters during operation of the apparatus, the distance between the first and second rotatable press rolls being one of the at least two of the plurality of variable operating parameters, in order to maintain the difference between the at least one desired value and the value of the measured specific control parameter below a predetermined difference. In a preferred embodiment, the method includes setting at least one desired value for a plurality of said specific control parameters, and adjusting at least two of the plurality of variable operating parameters during operation of the apparatus to maintain the difference between the at least one desired value and the value of the measured specific control parameter below the predetermined difference.

In accordance with one embodiment of the method of the present invention, the method includes urging the at least one of the first and second rotatable press rolls away from the other of the first and second rotatable press rolls by means of at least one hydraulic driving device.

In accordance with another embodiment of the method of the present invention, the plurality of variable operating parameters includes the torque of the first and second rotatable press rolls and the linear load thereon, and the method includes adjusting at least the torque of the first and second rotatable press rolls during operation of the apparatus to maintain the difference between the at least one desired value and the value of the measured specific control parameter below the predetermined difference.

In accordance with another embodiment of the method of the present invention, the plurality of variable operating parameters includes the vat pressure and the rotational speed of the first and second rotatable press rolls, and the method includes adjusting at least one of the vapor pressure and the rotational speed of the first and second rotatable press rolls during operation of the apparatus to maintain the difference between the at least one desirable value and the value of the measured specific control parameter below the predetermined difference.

In accordance with another embodiment of the method of the present invention, the plurality of control parameters includes the outlet pulp consistency.

In accordance with another embodiment of the method of the present invention, the plurality of control parameters includes the vat pressure.

In accordance with another embodiment of the method of the present invention, the plurality of control parameters includes the distance between the first and second rotatable press rolls, the torque of the first and second rotatable press rolls, and/or the linear load thereon.

In accordance with another embodiment of the method of the present invention, the apparatus includes a pulp distribution device for each of the first and second rotatable press rolls for distributing pulp onto each of the respective first and second rotatable press rolls, and the plurality of control parameters includes the ratio between the rotational speed of the first and second rotatable press rolls and the flow rate of the pulp from the pulp distribution device. In a preferred embodiment, the plurality of variable operating parameters includes the flow rate of the pulp from the pulp distribution device, and the method includes adjusting the flow rate of the pulp from the pulp distribution device during operation of the apparatus to maintain the difference between the at least one desired value and the value of the measured specific control parameter below the predetermined difference.

In accordance with the present invention, this and other objects have also been realized by the invention of a system for controlling an apparatus for washing and dewatering pulp comprising first and second rotatable press rolls, each of the first and second rotatable press rolls having a permeable outer surface, and a vat in which the first and second rotatable press rolls are installed, the first and second rotatable press rolls being juxtaposed with each other to define a press nip for pressing the pulp therebetween, feed means for feeding the pulp in the direction of rotation of the first and second rotatable press rolls through the press nip, at least one of the first and second rotatable press rolls being movable in relation to the other of the first and second rotatable press rolls to vary the press nip, whereby the processing of the pulp in the apparatus is determined by a plurality of variable operating parameters which are variable during operation of the apparatus, the system comprising setting means for setting at least one desired value for a specific control parameter of a plurality of control parameters, measuring means for measuring the specific control parameter, the plurality of variable operating parameters including the distance between the first and second rotatable press rolls, and including adjustment means for adjusting at least two of the plurality of variable operating parameters during operation of the apparatus, the plurality of variable operating parameters including the distance between the first and second rotatable press rolls, in order to maintain the difference between the at least one desired value and the value of the measured specific control parameter below a predetermined difference. In a preferred embodiment, the setting means is adapted to set at least one desired value for a plurality of the specific control parameters, and the adjustment means is adapted to adjust a plurality of the variable operating parameters during operation of the apparatus in order to maintain the difference between the at least one desired value and the value of the measured specific control parameter below the predetermined difference.

In accordance with one embodiment of the system of the present invention, the adjustment means is adapted to adjust the distance between the first and second rotatable press rolls and comprises at least one hydraulic driving device for urging one of the first and second rotatable press rolls away from the other of the first and second rotatable press rolls.

In accordance with another embodiment of the system of the present invention, the plurality of variable operating parameters includes the torque of the first and second rotatable press rolls and the linear load thereon, and the adjustment means comprises means for adjusting the torque of the first and second rotatable press rolls during operation of the apparatus.

In accordance with another embodiment of the system of the present invention, the plurality of variable operating parameters includes the vat pressure and the rotational speed of the first and second rotatable press rolls, and wherein the adjustment means comprises means for adjusting the vat pressure and means for adjusting the rotational speed of the first and second rotatable press rolls during operation of the apparatus.

In accordance with another embodiment of the system of the present invention, the plurality of control parameters includes the output pulp consistency, and wherein the setting means is adapted to set at least one desired value for the outlet pulp consistency, and the measuring means includes means for measuring the output pulp consistency.

In accordance with another embodiment of the system of the present invention, the plurality of control parameters includes the vat pressure, and wherein the setting means is adapted to set a least one desired value for the vat pressure, and the measuring means comprises means for measuring the vat pressure.

In accordance with another embodiment of the system of the present invention, the plurality of control parameters includes the distance between the first and second rotatable press rolls, the torque of the first and second rotatable press rolls, and/or the linear load thereon, and wherein the setting means is adapted to set at least one desired value for the distance between the first and second rotatable press rolls, the torque of the first and second rotatable press rolls, and the linear load thereon, and the measuring means comprises means for measuring at least one of the at least one control parameters.

In accordance with another embodiment of the system of the present invention, the system includes a pulp distribution device for each of the first and second rotatable press rolls for distributing pulp onto each of the respective press rolls, and wherein the plurality of control parameters includes the ratio between the rotational speed of the first and second rotatable press rolls and the flow rate of the pulp from the pulp distribution device, and wherein the setting means is adapted to set at least one desired value for the ratio, and the measuring means comprises means for measuring the ratio. In a preferred embodiment, the plurality of variable operating parameters includes the flow rate of the pulp from the pulp distribution device, and wherein the adjustment means comprises means for adjusting the flow rate of the pulp from the pulp distribution device.

In accordance with the present invention, this and other objects have also been realized by the invention of an apparatus for washing and dewatering pulp comprising first and second rotatable press rolls, each of the first and second rotatable press rolls including a permeable outer surface, and a vat in which the first and second rotatable press rolls are installed, the first and second rotatable press rolls juxtaposed with each other to define a press nip for pressing the pulp therebetween, feed means for feeding the pulp in the direction of rotation of the first and second rotatable press rolls through the press nip, at least one of the first and second rotatable press rolls being movable in relation to the other of the first and second rotatable press rolls to vary the press nip, whereby the processing of the pulp in the apparatus is determined by a plurality of variable operating parameters which are variable during operation of the apparatus, and a system for controlling the apparatus, comprising setting means for setting at least one desired value for a specific control parameter of a plurality of control parameters, measuring means for measuring the specific control parameter, the plurality of variable operating parameters including the distance between the first and second rotatable press rolls, and including adjustment means for adjusting at least two of the plurality of variable operating parameters during operation of the apparatus, the plurality of variable operating parameters including the distance between the first and second rotatable press rolls in order to maintain the difference between the at least one desired value and the value of the measured specific control parameter below a predetermined difference. In a preferred embodiment, the apparatus comprises a pulp distribution device for each of the first and second rotatable press rolls for distributing the pulp onto the respective press rolls, a pulp distribution device for each of the first and second rotatable press rolls for distributing pulp on the respective press rolls, and wherein the plurality of control parameters includes the ratio between the rotational speed of the first and second rotatable press rolls and the flow rate of the pulp from the pulp distribution device, and wherein the setting means is adapted to set at least one desired value for the ratio, and the measuring means comprises means for measuring the ratio.

In accordance with a preferred embodiment, the apparatus comprises a pulp distribution device for each of the first and second rotatable press rolls for distributing pulp onto the respective press rolls, wherein the plurality of variable operating parameters includes the flow rate of the pulp from the pulp distribution device, and wherein the adjustment means comprises means for adjusting the flow rate of the pulp from the pulp distribution device.

In accordance with the present invention, this and other objects have also been realized by the invention of a plant for processing pulp, the plant comprising apparatus for washing and dewatering pulp as described above. Preferably, the plant includes a pulp distribution device for each of the first and second rotatable press rolls for distributing the pulp onto each of the respective press rolls.

In accordance with the present invention, the performance and the flexibility of the apparatus can be improved with regard to the desired value for a specific control parameter, whereby the capacity of the apparatus is improved. In accordance with the present invention, it is now easier to maintain a specific control parameter within a desired and suitable range, whereby the desired quality of the pressed pulp is attained in an efficient way. Use of the press nip as a variable operating parameter, i.e. the active adjustment of the press nip/distance between the press rolls during operation, improves the flexibility and performance of the apparatus, and a requested process result is attained in an efficient way. By means of the present invention, the performance of this apparatus is improved since the washing efficiency and the capacity are increased. The capacity of the apparatus is increased since a larger amount of pulp, having a more precise particular quality, per unit of time can be produced. By means of the present invention, it is now possible to come closer to the maximum capacity which the apparatus can manage. The improved processing of pulp in an apparatus for washing and dewatering pulp comprising two rotatable press rolls is thus provided for by the present invention.

The desired value for a specific control parameter can be set by operator during the operation of the apparatus, and also changed during such operation. Adjustment of the variable operating parameters in order to maintain the difference below a certain predetermined level can be performed on the basis of different types of algorithms or techniques, depending on the number of variable operating parameters being adjusted. For example, several operating parameters can be adjusted simultaneously, or one operating parameter can be adjusted at a time.

By "during operation" is meant during ongoing operation of the apparatus, i.e. the operating parameters are adjustable while the apparatus is continuously running, running idly, or while pressing and washing pulp, without being forced to shut down the apparatus. The axes of rotation of the press rolls can be in substantially the same horizontal plane, and the movable press roll is then laterally movable in relation to the other, or the axes of rotation of the press rolls can be positioned in other ways. The axes of rotation of the press rolls can, for example, be in substantially the same vertical plane, and the movable press roll is then movable in a substantially vertical direction, upwards or downwards.

According to an advantageous embodiment of the method according to the present invention, the method is further characterized by setting at least one desired value for two or more specific control parameters, and by adjusting at least two of the variable operating parameters of that set during operation to keep that difference below the predetermined level. This further improves the performance and the flexibility of the apparatus, whereby a desired quality of the pressed pulp can be attained in a more efficient way.

According to a further advantageous embodiment of the method according to the present invention, the movable press roll is urged away from the other press roll by means of at least one hydraulic driving device. This improves the performance and the flexibility of the apparatus, whereby a desired quality of the pressed pulp can be attained in a more efficient way.

According to another advantageous embodiment of the method according to the present invention, the method is further characterized by including the torque of the press rolls and the linear load as variable operating parameters in the set, and by adjusting at least the torque of the press rolls during operation to keep that difference below the predetermined level. This further improves the performance and the flexibility of the apparatus, whereby a desired quality of the pressed pulp can be attained in a more efficient way.

According to still another advantageous embodiment of the method according to the present invention, the method is further characterized by including the vat pressure and the rotational speed of the press rolls as variable operating parameters in the set, and by adjusting at least one of these parameters during operation to keep that difference below the predetermined level. The inventors have found that this further improves the performance and the flexibility of the apparatus.

According to yet another advantageous embodiment of the method according to the present invention, outlet pulp consistency is included as a control parameter in the group. Tests performed by the inventors show that this further improves the performance and the flexibility of the apparatus, and that a desired quality of the pressed pulp can be attained in an even more efficient way.

According to an advantageous embodiment of the method according to the present invention, the vat pressure is included as a control parameter in said group. The inventors have found that this further improves the performance and the flexibility of the apparatus.

According to a further advantageous embodiment of the method according to the present invention, the method is further characterized by including the distance between the press rolls, the torque of the press rolls and/or the linear load as control parameters in the group. In this manner, the performance and the flexibility of the apparatus are further improved, and a desired quality of the pressed pulp is attained in a more efficient way.

According to a further advantageous embodiment of the method according to the present invention, the method is further characterized by providing the apparatus with a pulp distribution device for each press roll for distributing pulp on the respective press roll, and by including the ratio between the rotational speed of the press roll and the flow rate of the pulp from the pulp distribution device as a control parameter in the group. Tests performed by the inventors show that this further improves the performance and the flexibility of the apparatus, and that a desired quality of the pressed pulp can be attained in an even more efficient way.

According to another advantageous embodiment of the method according to the present invention, the method is further characterized by including the flow rate of the pulp from the pulp distribution device as a variable operating parameter in the set, and by adjusting this variable operating parameter during operation to maintain said difference below the predetermined level. Tests performed by the inventors show that this improves the performance and the flexibility of the apparatus, and that a desired quality of the pressed pulp is attained in an even more efficient way.

According to an advantageous embodiment of the system according to the present invention, the setting means are adapted to set at least one desired value for two or more specific control parameters, and the adjustment means are adapted to adjust at least one of the variable operating parameters of the set during operation to maintain the difference below the predetermined level.

According to a further advantageous embodiment of the system according to the present invention, the means for adjusting the distance between the press rolls comprise at least one hydraulic driving device for urging the movable press rolls away from the other.

According to another advantageous embodiment of the system according to the present invention, the torque of the press rolls and the linear load are included as variable operating parameters in the set, and the adjustment means comprises means for adjusting the torque of the press rolls during operation.

According to still another advantageous embodiment of the system according to the present invention, the vat pressure and the rotational speed of the press rolls are included as variable operating parameters in the set, and the adjustment means comprise means for adjusting the vat pressure, and means for adjusting the rotational speed of the press rolls, during operation.

According to yet another advantageous embodiment of the system according to the present invention, outlet pulp consistency is included as a control parameter in the group, the setting means are adapted to set at least one desired value for the outlet pulp consistency, and the measuring means comprise means for measuring the outlet pulp consistency.

According to an advantageous embodiment of the system according to the present invention, vat pressure is included as a control parameter in the group, the setting means are adapted to set at least one desired value for the vat pressure, and the measuring means comprise means for measuring the vat pressure.

According to a further advantageous embodiment of the system according to the present invention, the distance between the press rolls, the torque of the press rolls and/or the linear load are included as control parameters in the group, the setting means are adapted to set at least one desired value for the distance between the press rolls, the torque of the press rolls and/or the linear load, and the measuring means comprise means for measuring any of these control parameters.

According to another advantageous embodiment of the system according to the present invention, the apparatus comprises a pulp distribution device for each press roll for distributing pulp on the respective press roll, the ratio between the rotational speed of the press roll and the flow rate of the pulp from the pulp distribution device is included as a control parameter in the group, the setting means are adapted to set at least one desired value for the ratio, and the measuring means comprise means for measuring the ratio.

According to yet another advantageous embodiment of the system according to the present invention, the flow rate of the pulp from the pulp distribution device is included as a variable operating parameter in the set, and the adjustment means comprises means for adjusting the flow rate of the pulp from the pulp distribution device.

The advantageous effects of each of the above-mentioned embodiments of the system of the present invention correspond to the above-mentioned advantageous effects resulting from the corresponding embodiment of the method disclosed above.

Further advantageous embodiments of the method and system according to the present invention will be appreciated from the detailed description of preferred embodiments set forth below.

By the addition of each variable operating parameter and each control parameter, it is possible to further improve the performance and the flexibility of the apparatus with regard to the desired value for one or several specific control parameters.

BRIEF DESCRIPTION OF THE DRAWINGS

The present invention will now be described, for exemplary purposes, in more detail in accordance with the following detailed description, which refers to the enclosed drawings, in which.

DETAILED DESCRIPTION

Figure 1:
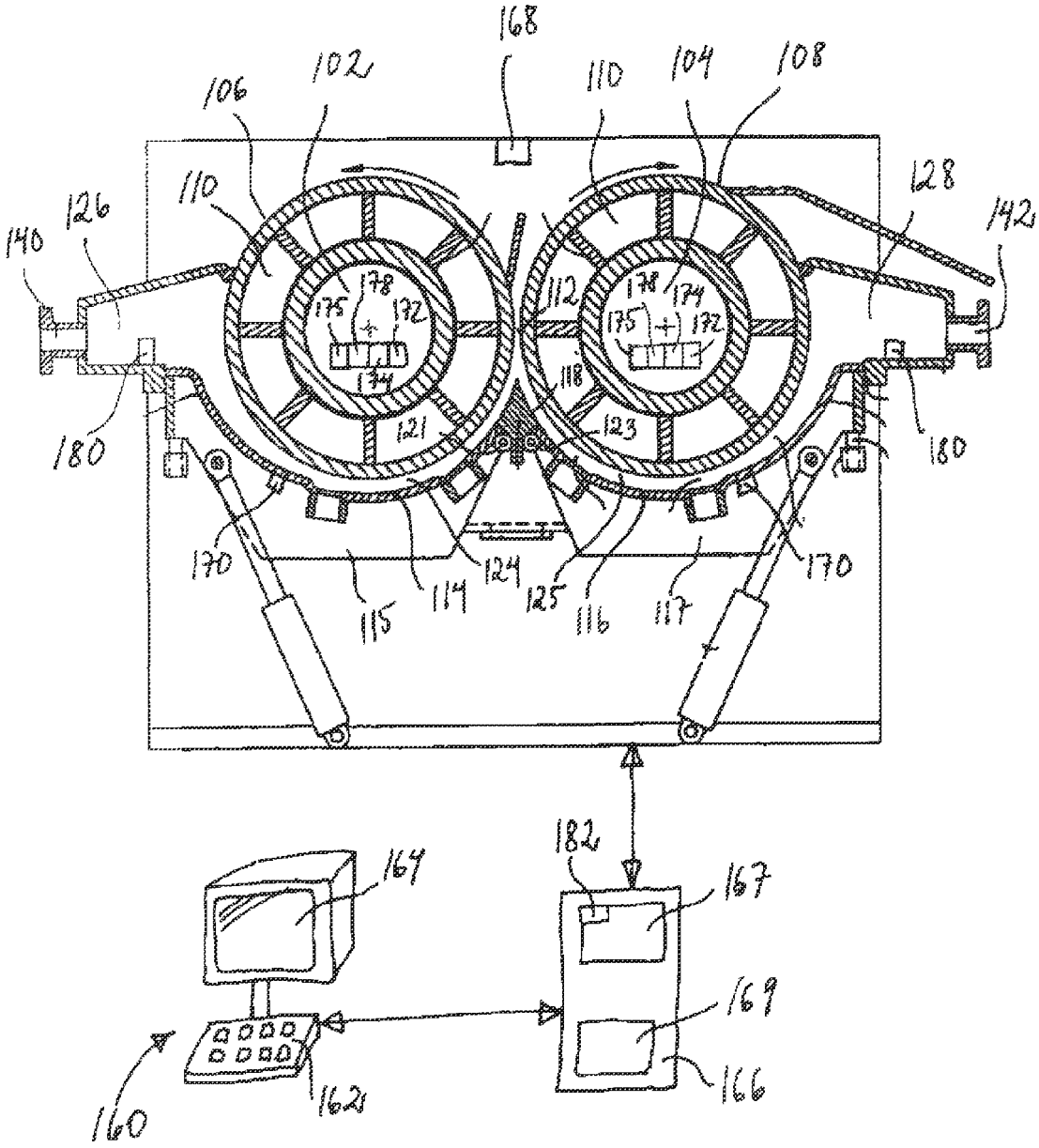
FIG. 1 is a side, elevational, a schematic view of an embodiment of the apparatus for washing and dewatering pulp provided with an embodiment of the system for controlling it according to the present invention.

FIG. 1 schematically shows an embodiment of the apparatus for washing and dewatering cellulose-containing pulp according to the present invention provided with an embodiment of the system according to the present invention schematically illustrated with block diagrams. The apparatus comprises a first rotatable press roll 102 and a second rotatable press roll 104, each press roll, 102 and 104, having a permeable outer surface, 106 and 108, which is perforated, i.e. provided with apertures, whereby the outer surface, 106 and 108, is permeable to filtrate pressed out of the pulp. The shape of the apertures is normally circular, but any shape is possible. The press rolls, 102 and 104, comprise a number of filtrate channels 110 radially inwards of the outer surface, 106 and 108, to lead evacuated filtrate away. The two press rolls, 102 and 104, define a press/roll nip 112 between them, in which press nip 112 the pulp is pressed, and are arranged to rotate in opposite directions, the left press roll 102 being arranged to rotate in a counter-clockwise direction and the right press roll 104 being arranged to rotate in clockwise direction. The apparatus is arranged to feed the pulp in the direction of rotation of the press rolls, 102 and 104, through the press nip 112. The axes of rotation of the press rolls, 102 and 104, being in substantially the same horizontal plane, and the apparatus is arranged to feed the pulp through the press nip 112 in a substantially vertical direction from below upwards. One of the press rolls, 102 and 104, herein the first press roll 102, is laterally movable in relation to the other press roll 104 to vary the press nip 112 under the operation of the apparatus. The processing of the pulp in the apparatus is determined by a set of variable operating parameters which are variable during operation.

The apparatus comprises a casing which includes a vat, 114, 116, and 118, in which the press rolls, 102 and 104, are installed, the vat, 114, 116, and 118, partly enclosing the outer surface, 106 and 108, of each press roll, 102 and 104, whereby a gap, 124 and 125, for each press roll, 102 and 104, is defined, limited by the vat, 114, 116, and 118, and the outer surface, 106 and 108, of the respective press roll, 102 and 104. The vat, 114, 116, and 118, can be pressurized and comprises a first side vat segment 114 which partly encloses the outer surface 106 of the first press roll 102, and a second side vat segment 116 which partly encloses the outer surface 108 of the second press roll 104.

The casing comprises a first casing member 115 which extends between the ends of the first press roll 102 and to which the first side vat segment 114 is mounted, and a second casing member 117 which extends between the ends of the second press roll 104 and to which the second side vat segment 116 is mounted. The first casing members 115 is pivotable about a first axle 121 and the second casing members 117 is pivotable about a second axle 123, whereby the casing members, 115 and 117, together with their side vat segments, 114 and 116, are movable between a closed position and an opened position for providing access to the press rolls. 102 and 104. Further, the vat, 114, 116, and 118, comprises a central vat segment 118 partly enclosing the outer surface, 106 and 108, of the press rolls, 102 and 104, between the press nip 112 and the side vat segments, 114 and 116.

The apparatus comprises a first pulp distribution device 126 for distributing pulp onto the first press roll 102 and a second pulp distribution device 128 for distributing pulp onto the second press roll 104. The pulp distribution devices 126, 128 are arranged to distribute pulp to the gap 124 along the whole length of each press roll 102, 104. The pulp distributed on the outer surface, 106 and 108, of the press roll, 102 and 104, forms a mat on the press rolls, 102 and 104. Herein, the pulp distribution device, 126 and 128, is in the form of a pulp distribution screw. However, other kinds of pulp distribution devices are possible. The pulp distribution device, 126 and 128, can also comprise several separate pulp distribution means distributed one after the other along the longitudinal extension of the press roll, 102 and 104. Each pulp distribution device, 126 and 128, is connectable to a pulp supplying system via connection means, 140 and 142, and the supplying system supplies pulp to each pulp distribution device, 126 and 128.

The apparatus also includes a pulp transport screw (not shown), which for example can be in the form of a pulp disintegrating screw or a shredder screw, towards which the pulp which has been pressed in the press nip 112 is conveyed. The pulp transport screw extends parallelly to the longitudinal axes of the press rolls, 102 and 104, and is arranged to disintegrate the pulp and transport the pulp axially away from the press for further processing.

The system of the present invention is adapted to control the apparatus by controlling a set of variable operating parameters which are variable during operation and determine the processing of the pulp in the apparatus. The operating parameters include apparatus parameters and process parameters, where the value of a process parameter is a result of the apparatus parameters or other parameters. The following variable operating parameters are included in the set:

- the distance between the press rolls, 102 and 104, which corresponds to the cross-section of the press-nip 112, which is defined as an apparatus parameter;
- the torque of the press rolls, 102 and 104, which is defined as an apparatus parameter;
- the linear load which acts on the pulp in the press nip 112 and is affected by the torque of the press rolls, 102 and 104, which is defined as a process parameter;
- the vat pressure, i.e. the pressure within the vat, which is defined as a process parameter;
- the rotation speed of the press rolls, 102 and 104, which is defined as an apparatus parameter or a process parameter;
- the inlet pulp consistency, which is defined as a process parameter; and
- the flow rate of the pulp from the pulp distribution devices, 126 and 128, which is defined as a process parameter.

Further variable operating parameters can also be included in the set.

The system comprises setting means 160 for setting at least one desired value for a specific control parameter, the specific control parameter being included in a group of control parameters. The setting means 160 includes a keyboard 162 by means of which the control parameters are set, and the system includes a display means 164 for displaying the set control parameter. The following control parameters are included in this group:

- the outlet pulp consistency;
- the vat pressure;
- the distance between the press rolls, 102 and 104;
- the torque of the press rolls, 102 and 104;
- the linear load;
- the flow rate of the pulp from the pulp distribution device, 126 and 128.
- the rotational speed of the press rolls, 102 and 104; and
- the ratio between the rotational speed of the press roll, 102 and 104, and the flow rate of the pulp from the pulp distribution device, 126 and 128.

Further control parameters can also be included in the group.

The system includes measuring means for measuring the specific control parameter, and the measuring means include means 168 for measuring the outlet pulp consistency, means 170 for measuring the vat pressure, means 172 for measuring the distance between the press rolls, 102 and 104, means 174 for measuring the torque of the press rolls, 102 and 104, means 175 for measuring the linear load, means 178 for measuring the rotational speed of the press rolls, 102 and 104, means 180 for measuring the flow rate of the pulp from the pulp distribution device, 126 and 128, and means 182 for measuring or calculating the above-mentioned ratio. Above-mentioned means for measuring are in the form of suitable sensors or equipment. The means 170 for measuring the vat pressure can be installed at various places in the vat, for example at the lowest region/-s in the vat, to measure the vat pressure there. The linear load can, for example, be measured by providing means 175 for measuring the linear load in connection to the bearings of the press rolls, 102 and 104, and to determine the linear load from the measured load on the bearings.

The system includes adjustment means for adjusting one or several of the variable operating parameters of the set during operation to maintain the difference between the set desired value and the value of the measured specific control parameter below a predetermined level. The predetermined level can be a positive value, for example close to zero, and the setting means 160 is adapted to set the level, for example by means of the keyboard 162 of the setting means 160. The adjustment means include means for adjusting the distance between the press rolls, 102 and 104, which means include hydraulic driving devices 202 for urging the laterally movable press roll 104 away from and towards the other press roll 102, and for providing and keeping a specific distance between the press rolls, 102 and 104, (see FIG. 2). However, other means for adjusting the distance between the press rolls, 102 and 104, are possible, such as means based on electromechanics. Further, the adjustment means include means for adjusting the torque of the press rolls during operation, which means are connected to the drive of the press rolls, 102 and 104, means for adjusting the vat pressure, which means are connected to the pressure controlling device of the vat, means for adjusting the rotational speed of the press rolls, which means are connected to the drive of the press rolls, 102 and 104, means for adjusting the flow rate of the pulp from the pulp distribution device, 126 and 128, which means are provided in the feed control of the pulp distribution devices, 126 and 128, and means for adjusting the inlet pulp consistency.

The adjustment means can be adapted to adjust only one variable operating parameter, or can be adapted to adjust two or more variable operating parameters. When adjusting two or more variable operating parameters, the adjustment means can be adapted to adjust several operating parameters simultaneously, or can be adapted to adjust one operating parameter at a time, and thereafter another.

The adjustment means, the measuring means, the setting means and the display means are connected to a control device 166 adapted to control the adjustment means and adapted to retrieve data from the measuring means and the setting means. The control device 166 comprises a processor 167 and storing means 169 for storing data. The control device 166 includes means 182 for calculating the ratio from the measurement of means 180 for measuring the flow rate of the pulp from the pulp distribution device, 126 and 128, and the means 178 for measuring the rotation speed of the press roll, 102 and 104.

The setting means 160 can be adapted to set at least one desired value for two or more specific control parameters, and the adjustment means are adapted to adjust at least one of the variable operating parameters of the set during operation to maintain that difference below the predetermined level.

Figure 2:
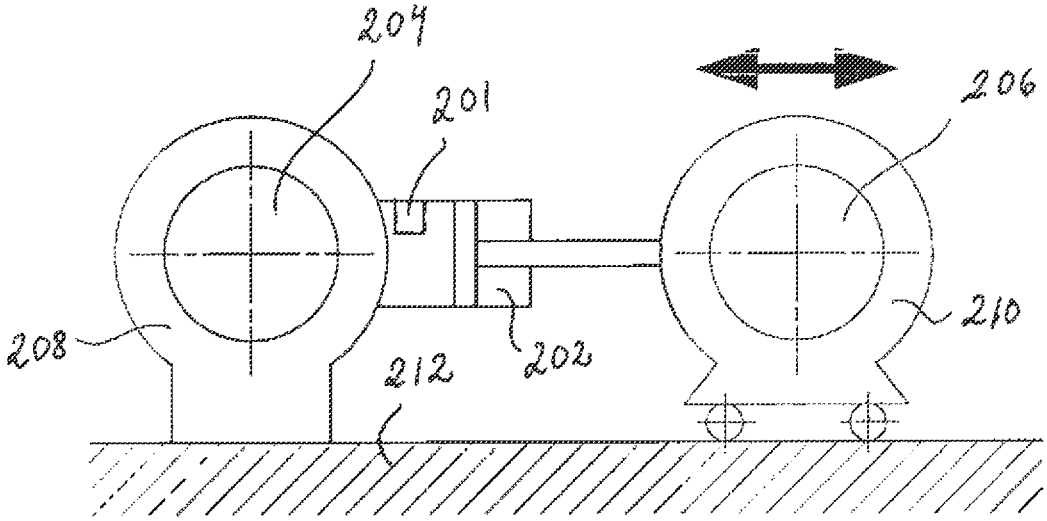
FIG. 2 is a side, elevational, schematic view illustrating a portion of one embodiment of the apparatus according to the present invention.

FIG. 2 schematically illustrates the pivotal mounting of the press rolls at the first end of the apparatus. The shaft 204 of the first press roll 102 and the shaft 206 of the second laterally movable press roll 104 are supported by bearings housed in bearing housings, 208 and 210. The bearing housing 208 of the first press roll 102 is fixedly attached to the casing 212 of the apparatus, and the bearing housing 210 of the laterally movable press roll 104 is movably attached to the casing 212, whereby the second press roll 104 is movable in relation to casing 212 and laterally movable in relation to the other press roll 102. The hydraulic driving device 202 is positioned between the shafts, 204 and 206, of the press rolls, 102 and 104, and is connected to the bearing housing, 208 and 210, of each press roll, 102 and 104. A corresponding hydraulic driving device is mounted at the second end of the apparatus. The hydraulic driving devices 202 are adapted to urge the laterally movable press roll 104 away from the other press roll 102 and towards the other press roll 102 for providing a specific distance between the press rolls, 102 and 104, and for keeping this distance. The means 174 for measuring the linear load is in the form of a load cell 201 connected to the hydraulic driving device 202.

Figure 3:
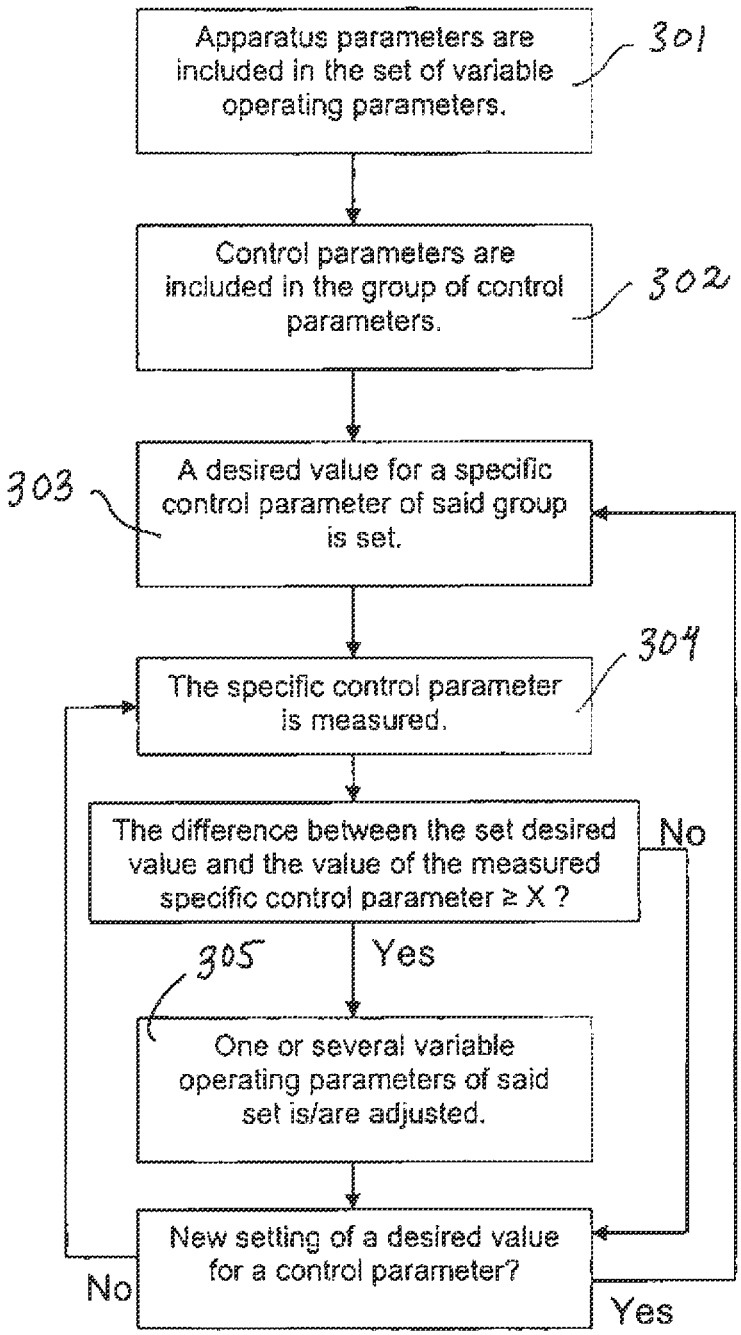
FIG. 3 is a schematic flow schedule illustrating aspects of the method according to the present invention.
Figure 4:
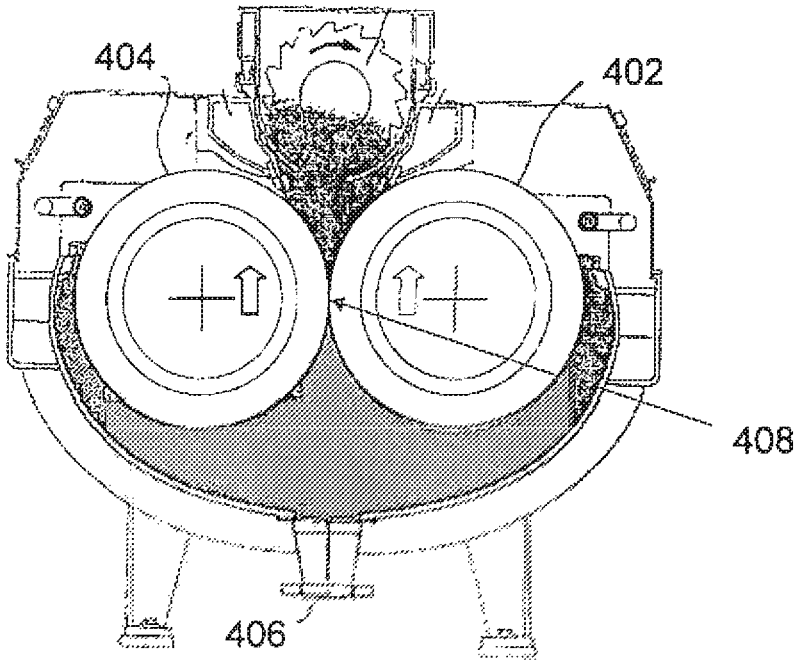
FIG. 4 is a side, elevational schematic view of another embodiment of the apparatus for washing and dewatering pulp to which the system according to the present invention can be applied.

FIG. 3 illustrates aspects of the method according to the present invention by way of a schematic flow schedule, which method is applicable to the apparatus shown in FIG. 1 and FIG. 4, for example, but can also be applied to other apparatus for washing and dewatering cellulose-containing pulp comprising two rotatable press rolls.

According to a first aspect of the method according to the present invention, the method is applicable to the apparatus shown in FIG. 1. The above-mentioned variable operating parameters are included in the set of variable operating parameters, at 301, and the above-mentioned control parameters are included in the group of control parameters, at 302. One desired value for a specific control parameter of this group is set, at 303. The specific control parameter is measured, at 304. If the difference between the set desired value and the value of the measured specific control parameter is above or equal to a certain predetermined level, X, one or several variable operating parameters of said set is/are adjusted, at 305, to decrease that difference. If the difference between the set desired value and the value of the measured specific control parameter is below the predetermined level, X, the operating parameters are maintained. The specific control parameter is measured continuously, and adjusted, if necessary, to keep the difference between the set desired value and the value of the measured specific control parameter below the predetermined level. Instead of setting one desired value, a desired value range, including several values, could be set. One desired value could also be set for two or more specific control parameters, for example a desired value for the linear load and a desired value for the vat pressure, etc.

According to a second aspect of the method according to the present invention, at least the distance between the press rolls, i.e. the size of the press nip, during operation is adjusted to keep that difference below the predetermined level, and this adjustment is performed by urging the movable press roll away from the other press roll or by urging the movable press roll towards the other press roll by means of at least one hydraulic driving device.

By means of the present invention, it is now possible to select different modes or pressing strategies by setting desired values for specific control parameters, and the performance of the apparatus is optimized with regard to the selected mode.

According to a third aspect of the method according to the present invention, a mode can be selected where a desired value for the vat pressure is set, whereby the performance of the apparatus is optimized with regard the capacity of the apparatus, irrespective of the present inlet pulp consistency or the flow rate of the pulp from the pulp distribution device. In this manner, the vat pressure is kept at a substantially fixed level, and the torque of the press rolls and the distance between the press rolls, respectively, are adjusted according to the present invention, and to a value as large as possible. Advantageously, the torque of the press rolls is adjusted before the distance between the press rolls.

According to a fourth aspect of the method according to the present invention, a mode can be selected where a high desired value for the outlet pulp consistency is set, whereby the performance of the apparatus is optimized to deliver high consistency pulp. In this manner, the linear load is adjusted (by adjusting the torque of the press rolls), the vat pressure is adjusted and the distance between the press rolls is adjusted according to the present invention, and to a value as large as possible. Advantageously, first the linear load is adjusted to a value as large as possible, then the vat pressure is adjusted, and finally the distance between the press rolls.

According to a fifth aspect of the method according to the present invention, a mode can be selected where a desired value for the ratio between the rotational speed of the press roll and the flow rate of the pulp from the pulp distribution device is set, whereby it is guaranteed that all of the outer surface of the press roll is covered with pulp from the pulp distribution device. In this mode, also a desired value for the vat pressure is set to keep it at a specific level, and the torque of the press rolls and the distance between the press rolls, respectively, are adjusted to a value as large as possible. Advantageously, the torque of the press rolls is adjusted before the distance between the press rolls.

According to a sixth aspect of the method according to the present invention, a mode can be selected where a desired value for the distance between the press rolls is set. In this manner, the distance between the press rolls is measured, the measured distance is compared with the desired value for the distance, whereupon the distance is adjusted to maintain the difference between the desired value for the distance and the value of the measured distance below a predetermined level, advantageously, the predetermined level is close to zero.

According to a seventh aspect of the method according to the present invention, a mode can be selected where a desired value for the linear load is set, and the distance between the press rolls is adjusted during operation to maintain the difference between the desired value for the linear load and the value of the measured linear load below a predetermined level.

According to a further aspect of the method according to the present invention, the method is applicable to the apparatus for washing and dewatering cellulose-containing pulp shown in FIG. 4, which does not have a distribution device for each press roll for distributing pulp on the respective press roll, as in the apparatus disclosed in FIG. 1. Instead, a pulp inlet 406 for receiving pulp is positioned in the bottom of the vat, whereupon pulp is conveyed through the press nip 408 between the press rolls, 402 and 404, from below upwards. According to this aspect, the ratio between the rotation speed of the press roll and the flow rate of the pulp from the pulp distribution device is then excluded as a control parameter in this group, and the flow rate of the pulp from the pulp distribution device is excluded as a variable operating parameter in the set.

The operating parameters can be affected by changes in other operating parameters, while some operating parameters are kept unchanged. For example, an increase in the torque of the press rolls results in a decrease of the rotational speed of the press rolls, an increase of the vat pressure and the outlet pulp consistency, whereas the flow rate of the pulp from the pulp distribution device, the inlet pulp consistency and the distance between the press rolls are kept unchanged.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for processing pulp in an apparatus for washing and dewatering said pulp comprising first and second rotatable press rolls, each of said first and second rotatable press rolls including a permeable outer surface, and a vat in which said first and second rotatable press rolls are installed, said first and second rotatable press rolls juxtaposed with each other to define a press nip for passing said pulp therebetween, feed means for feeding said pulp in the direction of rotation of said first and second rotatable press rolls through said press nip, at least one of said first and second rotatable press rolls being movable in relation to the other of said first and second rotatable press rolls to vary said press nip, whereby the processing of said pulp in said apparatus is determined by a plurality of manipulated variables which are adjusted during operation, said method comprising including the distance between said first and second rotatable press rolls as one of said plurality of manipulated variables, setting at least one desired value for a specific controlled variable of a plurality of controlled variables, measuring said specific controlled variable, and adjusting at least two of said plurality of manipulated variables during operation of said apparatus, said distance between said first and second rotatable press rolls being one of said at least two of said plurality of manipulated variables, in order to maintain the difference between said at least one desired value and the value of said measured specific controlled variable below a predetermined difference, wherein the said distance between said first and second rotatable press rolls is actively adjusted by means of at least a driving device controlled by a computer control device.

2. The method according to claim 1, including setting at least one desired value for a plurality of said specific controlled variables, and adjusting at least two of said plurality of manipulated variables during operation of said apparatus to maintain said difference between said at least one desired value and the value of said measured specific controlled variable below said predetermined difference.

3. The method according to claim 1, including urging said at least one of said first and second rotatable press rolls away from the other of said first and second rotatable press rolls by means of at least one hydraulic driving device.

4. The method according to claim 1, wherein said plurality of manipulated variables includes the torque of said first and second rotatable press rolls and the linear load thereon, and said method includes adjusting at least said torque of said first and second rotatable press rolls during operation of said apparatus to maintain said difference between said at least one desired value and the value of said measured specific controlled variable below said predetermined difference.

5. The method according to claim 1, wherein said plurality of manipulated variables includes the vat pressure and the rotational speed of said first and second rotatable press rolls, and said method includes adjusting at least one of said vat pressure and said rotational speed of said first and second rotatable press rolls during operation of said apparatus to maintain said difference between said at least one desired value and the value of said measured specific controlled variable below said predetermined difference.

6. The method according to claim 1, wherein said plurality of controlled variables includes the outlet pulp consistency.

7. The method according to claim 1, wherein said plurality of controlled variables includes the vat pressure.

8. The method according to claim 1, wherein said plurality of controlled variables includes at least one controlled variable selected from the group consisting of, the torque of said first and second rotatable press rolls and the linear load thereon.

9. The method according to claim 1, wherein said apparatus includes a pulp distribution device for each of said first and second rotatable press rolls for distributing pulp onto each of said respective first and second rotatable press rolls, and wherein said plurality of controlled variables includes the ratio between the rotational speed of said first and second rotatable press rolls and the flow rate of said pulp from said pulp distribution device.

10. The method according to claim 9, wherein said plurality of manipulated variables includes the flow rate of said pulp from said pulp distribution device, and said method including adjusting said flow rate of said pulp from said pulp distribution device during operation of said apparatus to maintain said difference between said at least one desired value and the value of said measured specific controlled variable below said predetermined difference.

11. A method for processing pulp in an apparatus for washing and dewatering said pulp comprising first and second rotatable press rolls, each of said first and second rotatable press rolls including a permeable outer surface, and a vat in which said first and second rotatable press rolls are installed, said first and second rotatable press rolls juxtaposed with each other to define a press nip for passing said pulp therebetween, feed means for feeding said pulp in the direction of rotation of said first and second rotatable press rolls through said press nip, at least one of said first and second rotatable press rolls being movable in relation to the other of said first and second rotatable press rolls to vary said press nip, whereby the processing of said pulp in said apparatus is determined by a plurality of manipulated variables which are adjusted during operation, said method comprising including the distance between said first and second rotatable press rolls as one of said plurality of manipulated variables, setting at least one desired value for a specific controlled variable of a plurality of controlled variables, measuring said specific controlled variable, and adjusting at least one of said plurality of manipulated variables during operation of said apparatus, said distance between said first and second rotatable press rolls being said at least one of said plurality of manipulated variables, in order to maintain the difference between said at least one desired value and the value of said measured specific controlled variable below a predetermined difference, wherein the said distance between said first and second rotatable press rolls is actively adjusted by means of at least a driving device controlled by a computer control device.

* * * * *

UNITED STATES PATENT AND TRADEMARK OFFICE

CERTIFICATE OF CORRECTION

PATENT NO. : 8,808,499 B2
APPLICATION NO. : 12/747648
DATED : August 19, 2014
INVENTOR(S) : Johan Bylander et al.

It is certified that error appears in the above-identified patent and that said Letters Patent is hereby corrected as shown below:

In the Specification

Column 15, line 7, after "of" (first instance) insert --the distance between said first and second rotatable press rolls,--.

Column 16, line 11, delete "are" and insert therefor --may be--.

Signed and Sealed this
Twenty-eighth Day of July, 2015

Michelle K. Lee

Michelle K. Lee
*Director of the United States Patent and Trademark Office*